US005293852A

United States Patent [19]

Lehner et al.

[11] Patent Number: 5,293,852

[45] Date of Patent: Mar. 15, 1994

[54] METHOD AND ARRANGEMENT FOR THE OPEN-LOOP AND/OR CLOSE-LOOP CONTROL OF AN OPERATING VARIABLE OF AN INTERNAL COMBUSTION ENGINE

[75] Inventors: Vera Lehner, Eberdingen; Ernst Wild, Oberriexingen; Helmut Janetzke, Hemmingen; Klemens Grieser, Langenfeld/Rheinland, all of Fed. Rep. of Germany

[73] Assignee: Robert Bosch GmbH, Stuttgart, Fed. Rep. of Germany

[21] Appl. No.: 856,918

[22] PCT Filed: Sep. 14, 1991

[86] PCT No.: PCT/DE91/00729

§ 371 Date: May 18, 1992

§ 102(e) Date: May 18, 1992

[87] PCT Pub. No.: WO92/05354

PCT Pub. Date: Apr. 2, 1992

[30] Foreign Application Priority Data

Sep. 18, 1990 [DE] Fed. Rep. of Germany ..... 4029537

[51] Int. Cl.[5] ..... F02D 41/14; F02D 41/16; F02D 31/00

[52] U.S. Cl. ..... 123/339; 123/357; 123/399

[58] Field of Search ..... 123/339, 350, 352, 357, 123/361, 399, 585, 674

[56] References Cited

U.S. PATENT DOCUMENTS

| | | | |
|---|---|---|---|
| 3,906,207 | 9/1975 | Rivere et al. | 123/416 X |
| 4,567,869 | 2/1986 | Peter et al. | 123/339 |
| 4,593,666 | 6/1986 | Lefevre et al. | 123/674 |
| 4,672,934 | 6/1987 | Peter et al. | 123/339 |
| 4,947,815 | 8/1990 | Peter | 123/399 |

*Primary Examiner*—Tony M. Argenbright
*Attorney, Agent, or Firm*—Walter Ottesen

[57] ABSTRACT

A method and an arrangement for open-loop control and/or closed-loop control of an operating variable of an internal combustion engine is suggested with a transfer element fixing the relationship between input and output variables in the form of a characteristic curve or characteristic field such as an electrically actuable actuator, which directly or indirectly influences the operating variable of the engine of a motor vehicle and which fixes the relationship between the driving and operating variable or a variable influencing this operating variable in the form of a characteristic curve or a characteristic field. The transfer element or the characteristic curve or the characteristic field is subjected to changes. By adapting the characteristic curve or the computation instruction representing the characteristic curve or the characteristic field, these are adapted to these changes. This adaptation is performed in such a manner that at least one region of the characteristic curve or of the characteristic field is rotated about a pregiven point which lies outside of the characteristic curve and is specific to the actuator or to the engine. This point is adaptable in the context of a long-term adaptation.

19 Claims, 7 Drawing Sheets

START

N
Y
200
Start State ?
204
N
Idle State ?
Y
206
Computation V
Y
Adaptation ?
N
Y
208
212
ΔQ = V−Q
202
Initialization
213
N
Y
ΔQ>Threshold
τ = S' V+A'
210
Integration
I new = I old + IK(ΔQ)
214
Limit
216
S'new = Inew f(U)
218
S' = S'new
220
τ = S' V+A'
222
END

METHOD AND ARRANGEMENT FOR THE OPEN-LOOP AND/OR CLOSE-LOOP CONTROL OF AN OPERATING VARIABLE OF AN INTERNAL COMBUSTION ENGINE

FIELD OF THE INVENTION

The invention relates to a method and an arrangement for the open-loop and/or closed-loop control of an operating variable of an internal combustion engine.

BACKGROUND OF THE INVENTION

In methods and arrangements for open-loop and/or closed-loop controlling an operating variable of an internal combustion engine, transfer elements are often used such as electrically actuable actuating elements which operate directly or indirectly on the operating variable to be open-loop or closed-loop controlled. The relationship between input and output variables or, with respect to the actuating element, between electrically driving variables and electrical operating variables or a variable influencing one of these operating variables is definable as a characteristic field or characteristic line. This relationship is fixed by means of such transfer elements. This characteristic field or this characteristic line is then subjected to influences which operate in a varying manner on the characteristic field or characteristic line so that the open-loop control and/or closed-loop control of the operating variable operates outside of its operating point provided during normal operation and sometimes at the periphery of its signal range. This can lead to a defective operation of the open-loop and/or closed-loop control which especially has negative effects on stability, precision and/or dynamic of the open-loop control and/or closed-loop control.

Influences of this kind can manifest, for example, with an actuator in a dependence of the actuator characteristic curve or actuator characteristic field on the temperature of the actuator winding. For a cold actuator, the winding of the actuator conducts a larger current than for a heated actuator for the same drive signal magnitude so that, for the same drive signal, a different value of the operating variable or of the variable influencing this operating variable is adjusted.

Battery voltage fluctuations have similar effects and, for an actuator controlling the air input, changes in the quantities of leakage air not influenceable by the actuator or changes of the ambient air pressure.

For this reason, measures for the adaptation of the trace of the actuator characteristic curve are provided in U.S. Pat. No. 4,672,934. This starts from an electromagnetic actuator having a pregiven characteristic curve which actuator is used for the air intake of the internal combustion engine for an idle engine speed control.

This adaptation undertakes a comparison between the desired value computed by the controller and the measured actual value of a variable influenced by the actuator and adjusts offset adaptation and slope adaptation independently of each other in dependence upon the comparison results in the operating branch of the characteristic curve which is the most linear. To avoid defective adaptations and for accelerating the adaptation procedure, release conditions are defined in U.S. Pat. No. 4,672,934 for the offset adaptation and slope adaptation which are related to each other.

The offset adaptation described there is however only capable of carrying out a correction of the characteristic curve at a single operating point. In operating states, wherein the influences on the actuator characteristic curve change rapidly, the course of the adaptation is therefore not satisfactory. In such an operating state, the offset adaptation, which is configured for rapid correction, operates continuously. This can lead to unsatisfactory running smoothness of the engine in this operating state. Only an intervention of the slope adaptation adapts the characteristic curve to the change circumstances and thereby quiets the adaptation operation and the running performance of the engine. The slope adaptation is subject to enabling conditions expanded because of function reasons since a repeated adaptation of the slope without adaptation of the base point can lead to defective functions of the open-loop control and/or closed-loop control system.

A transmission of the known actuator characteristic curve adaptation to pressure control systems (that is, systems which obtain the load information needed for determining the quantity of fuel to be metered on the basis of a signal representing the pressure in the intake pipe) is not possible. Especially in the transition from the part-load region into the idle state, a load value which is too high is determined from the pressure signal since the pressure signal supplies a correct load signal only after several work strokes. An adaptation carried out in this transition region would be defective and could possibly lead to unwanted operating conditions.

The invention therefore has the task to provide measures which improve the adaptation of the open-loop control or closed-loop control of an operating variable of an internal combustion engine to operating circumstances which change.

This is achieved by an adaptation of the characteristic field or the characteristic curve of the transfer element or of the actuator with at least one region of the characteristic field or the characteristic curve being rotated about a pregiven pivot point (A) specific to the actuator and lying outside of the characteristic field or the characteristic curve. The offset adaptation and slope adaptation known from the state of the art are carried out at the same time.

A further improvement of this characteristic field adaptation or characteristic curve adaptation is obtained in that a long-term adaptation of the pivot point (A) lying outside of the characteristic field or outside of the characteristic curve is undertaken for adaptation to conditions specific to the actuator.

One such actuator for controlling the throttle flap of an internal combustion engine in connection with an electronic accelerator pedal is known from U.S. Pat. No. 4,947,815.

SUMMARY OF THE INVENTION

The procedure according to the invention leads to an adaptation of the characteristic field or the characteristic curve of the transfer element or of the actuator, which does not influence in a deteriorating manner the operating performance of the internal combustion engine for a rapid adaptation to changing operating circumstances, since the separate adaptation of offset and slope is omitted and only one parameter of the characteristic curve or of the characteristic field is adapted to the changing operating circumstances with said adaptation being known from the state of the art for actuator characteristic curves.

With the application of the procedure of the invention to the actuator of an idle engine speed control, a satisfactory operating performance is obtained even in critical operating regions such as the after-start phase.

An adaptation of the rotation point to the changing conditions specific to the actuator is obtained by means of a long-term adaptation of the pivot point (A) lying outside of the characteristic field or outside of the characteristic curve. In a further embodiment, information about the actuator can be obtained advantageously from the adapted pivot point for the purpose of diagnosis.

Further advantages of the invention will become evident from the description of the embodiments which follows.

BRIEF DESCRIPTION OF THE DRAWINGS

The invention is explained in the following with respect to the embodiments shown in the drawing.

In FIG. 5, a pivot point adaptation and a slope adaptation are shown with respect to a characteristic curve diagram; whereas.

DESCRIPTION OF THE PREFERRED EMBODIMENTS OF THE INVENTION

Figure 1:
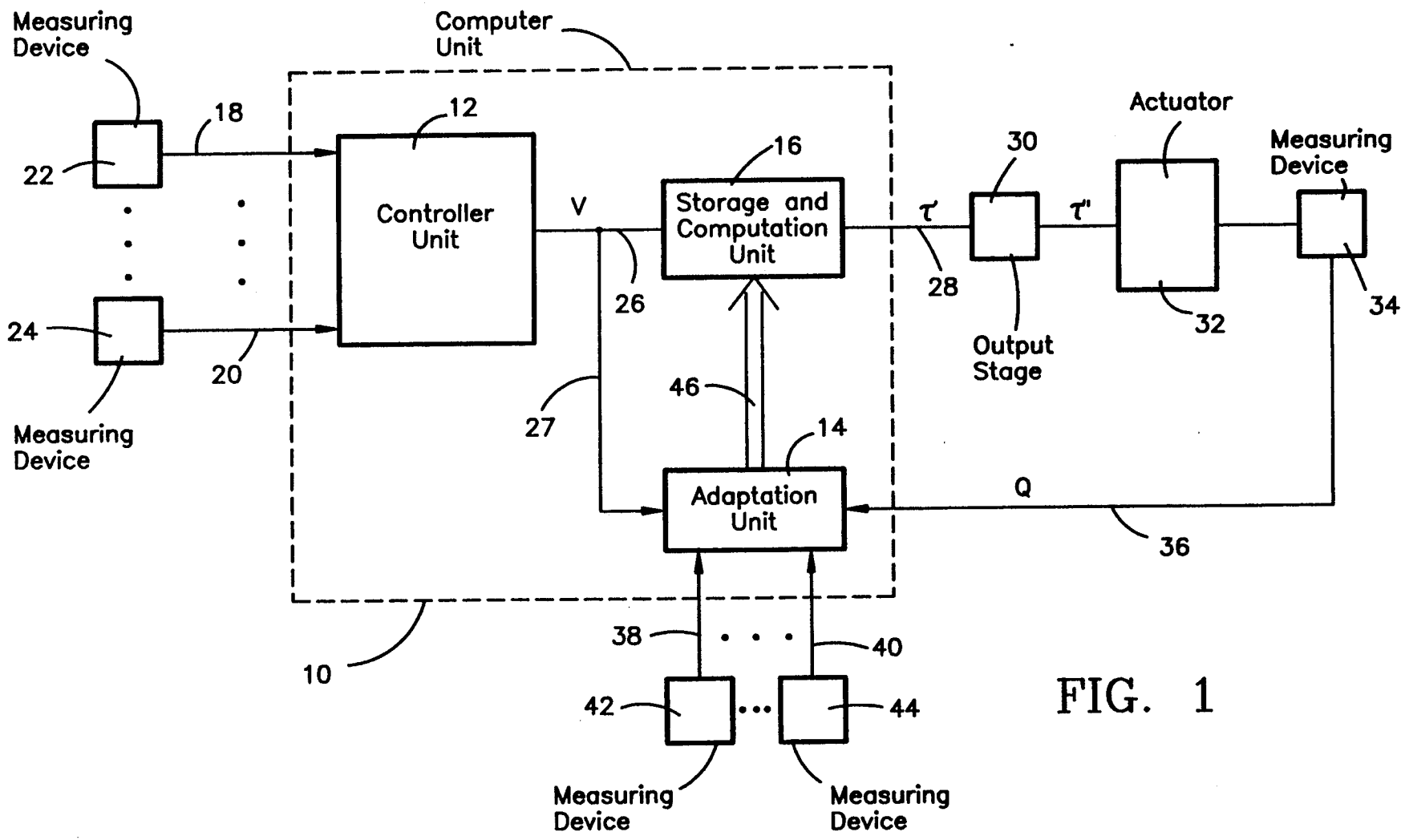
FIG. 1 shows a general overview block circuit diagram of a control system with an idle engine speed control as an example having actuator characteristic curve adaptation; whereas, in FIGS. 2*a* and 2*b*, a characteristic curve as well as the effects of the characteristic curve adaptation are shown as exemplary.

Utilizing an idle engine speed control in the form of an overview block circuit diagram as an example, FIG. 1 shows an open-loop and/or closed-loop control system for an operating variable of an internal combustion engine, with the system having means for the adaptation of the characteristic curve of the actuator. A computer unit 10 is provided which includes a controller unit 12, an adaptation unit 14 and a storage and computation unit 16.

Operating parameters of the internal combustion engine (not shown) or of the motor vehicle are transmitted to the controller unit 12 via the input lines 18 to 20. The operating parameters are detected by appropriate measuring devices 22 to 24. These operating parameters are the parameters necessary for the open-loop control and/or closed-loop control of the operating variable familiar from the state of the art. In the case of an idle engine speed closed-loop control, these parameters are especially engine speed, engine temperature, battery voltage, a load detection signal, idle-state signal, et cetera.

The controller unit 12 determines a desired value for the engine speed from the operating parameters supplied thereto. The controller compares the desired value to the current measured actual engine speed and, from the difference, determines an input value V for a variable characterizing the air throughput through the engine with the variable being, for example, air quantity, air mass, pressure in the intake pipe or throttle flap position. This input value V is supplied via the output line 26 of the controller unit 12 to the adaptation unit 14 as well as to the storage and computation unit 16.

Figure 2A:
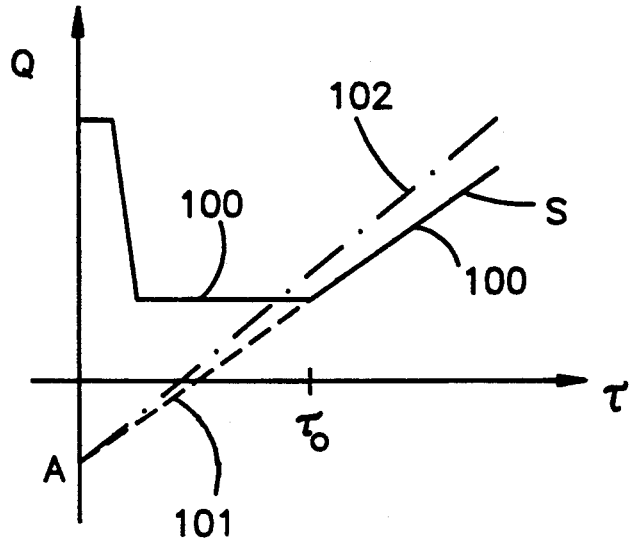
Figure 2B:
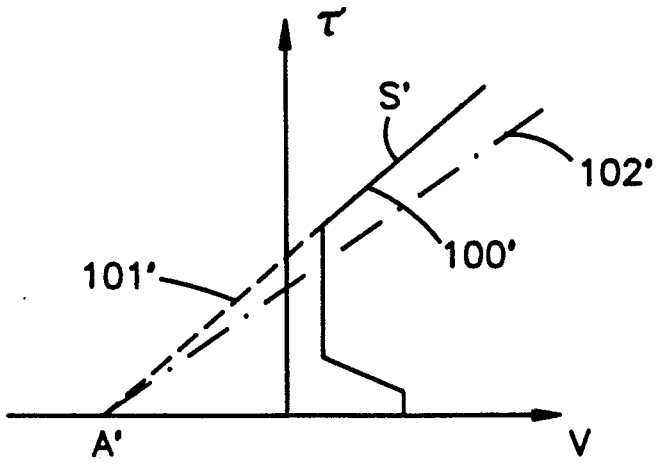

In dependence upon this determined value, the drive signal variable $\tau$ is computed by the storage and computation unit 16 according to a computation instruction defining the inverse characteristic curve corresponding to FIG. 2*b* or, by means of the inverse actuator characteristic curve stored there in table form, a drive signal value $\tau$ is determined for the actuator and emitted via the output line 28 of the computer unit 10 to an output stage circuit 30 for an actuator 32 influencing the operating variable indirectly or directly.

In the case of the embodiment of an idle engine speed control, the actuator 32 is an actuator influencing the air input to the internal combustion engine or the fuel input to the internal combustion engine with the actuator being a throttle flap or a bypass actuator or, in the case of a diesel internal combustion engine, a control rod. The actuator characteristic curve of actuator 32, which defines the allocation of the drive signal $\tau$ to the variable of the operating variable to be open-loop controlled or closed-loop controlled or to a signal representing these operating variables, is, in the case of a so-called one-winding rotary actuator for influencing the air input to the engine, configured as shown in FIG. 2*a*. The inverse actuator characteristic curve shown in FIG. 2*b* is derived therefrom. This characteristic curve is stored in the storage and computation unit 16, for example, as a computation instruction or in the form of a table.

The measuring device 34 is connected to the actuator 32. In this measuring device 34, the actual magnitude of the operating variable influenced by the actuator 32 is measured and supplied via the line 36 to the computer unit 10 or to the adaptation unit 14. In the case of an actuator 32 influencing the air input to the engine, the magnitude Q determined by the measuring device 34 for the air flow to the engine is the instantaneous air quantity, air mass, intake pressure and/or throttle flap position supplied to the engine; whereas, the measuring device 34 is itself correspondingly an air-quantity sensor, air-mass sensor, pressure sensor or throttle flap position transducer.

The desired or input value V is determined by the controller unit 12 for the operating variable and the actual variable Q of this operating variable is determined by means of the measuring device 34. In addition to the desired or input value V and the actual variable Q, the adaptation unit 14 is supplied with information about the operating state of the engine via further input lines 38 to 40 from corresponding measuring devices 42 to 44. The desired value V is supplied to the adaptation unit 14 via the line 27 which connects adaptation unit 14 and line 26 to each other. This concerns especially data concerning the start and idle state of the engine, a load signal and the battery voltage. The measuring devices 42 to 44 can be identical to the corresponding measuring devices 22 to 24 which have been described in connection with the controller unit 12. The characteristic curve parameters are determined in dependence upon their input signals by the adaptation unit 14 and are supplied via line or bus connection 46, which connects adaptation unit and storage and computation unit 16, to the storage and computation unit 16. The inverse characteristic curve is defined in the storage and computation unit 16 as a computation instruction or in the form of a table and is changed or adapted corresponding to the values supplied by the adaptation unit 14 via the line 46.

The arrangement of FIG. 1 is principally conceivable for all open-loop and/or closed-loop control systems of the engine which have an actuator having characteristic curves changeable by outside influences. The procedure of the invention can be especially applied also to an actuator of an electronic engine control system, that is, an electronic accelerator pedal.

The arrangement is transferrable in an advantageous manner to an engine speed control system with desired value V and actual value Q in this case defining the variable representing the speed of the engine.

In addition, this arrangement and the procedure to be described below is applicable in an advantageous further embodiment also to transfer elements having characteristic fields.

In FIGS. 2*a* and 2*b*, an actuator characteristic curve is, for example, shown as it is given for a one-winding rotational actuator equipped with a single-phase motor or for a two-winding rotary actuator equipped with a two-phase motor. These actuators are especially used as bypass actuators for idle controls. The procedure according to the invention is, however, applicable in an advantageous manner also to other characteristic curve forms.

In FIG. 2*a*, the actual air supply Q, which is supplied by means of the cross-sectional opening of the actuator, is plotted against the drive signal variable $\tau$. The solid line 100 represents the characteristic curve of the actuator 32. In the right-hand portion, a region is provided with a linear trace of the characteristic curve which concerns the working branch of the actuator. This working branch is viewed in combination with the illustration of the procedure according to the invention. This operating branch can be described mathematically by a straight-line equation having a positive slope S and a negative axis segment A (see line 101 shown broken).

This axis segment A represents a value by which the air quantity flowing through the actuator is less for a specific drive signal variable than this air quantity would be if the characteristic curve would go through the zero point of the $\tau$/Q-system. This axis segment thus defines a constructive point of the particular actuator.

Stated otherwise, the axis segment A is the intersect point of the vertical axis of the $\tau$/Q-system with the extension 101 of the operating branch of the characteristic curve 100, that is, the fictitious value for the supplied air quantity for the drive variable $\tau$=zero, when the pregiven region of the characteristic curve (in this case, the line-shaped segment) is taken as the basis, that is, on the basis of the particular selected region of the characteristic curve or of the characteristic field.

The axis segment A is still subjected to changes which are caused by leakage air specific to the actuator or engine, that is, the supplied air quantity which cannot be influenced by the actuator. These changes cause a shift of the characteristic curve axis segment A upwardly.

For the region of drive variables which become less, the air quantity increases again after a horizontal segment until a fixed value, the so-called emergency cross section, is reached which permits an operation of the engine when the control signal or actuator motor malfunctions.

An actuator with a corresponding characteristic curve in combination with an E-gas system is disclosed in U.S. Pat. No. 4,847,815.

FIG. 2*b* shows the inverse characteristic curve 100' for which the drive signal variable $\tau$ is plotted against the input value V determined by the controller unit 12. The characteristic curve 100' is derived from the characteristic curve of FIG. 2*a*. The inverse operating segment is then likewise characterized by slope S' and axis segment A' (see line 101' shown broken). In the ideal case, the variables or parameters characterizing the characteristic curves correspond in amount. This correspondence is disturbed by the influences described initially.

Figure 3:
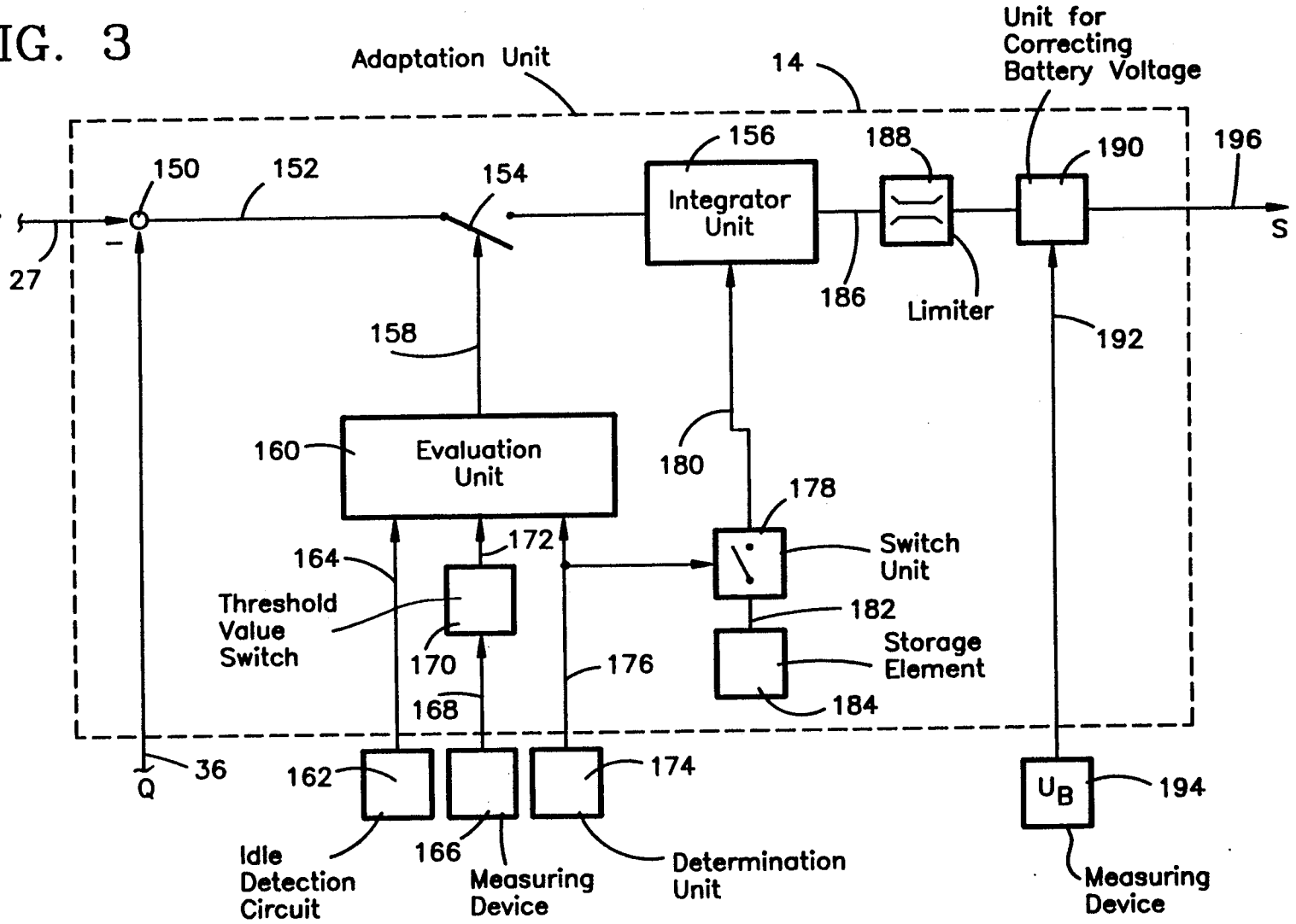
FIG. 3 shows a detailed block circuit diagram for the characteristic curve adaptation; whereas, in FIG. 4, a flowchart is shown which makes clear the adaptation of the characteristic curve as a sketch of a computer realization.

FIG. 3 shows an embodiment of the adaptation unit 14. The unit 14 shown in phantom outline has lines 27 and 36 as input lines which were described above with respect to FIG. 1. The input values V determined by the controller unit 12 and the determined actual values Q are supplied on these lines.

The difference between the input and actual values is formed in a comparator position 150 and the difference value is transmitted on a line 152 via a switch 154 to an integrator unit 156. The switch unit 154 is activated via a signal determined in an evaluation unit 160 and transmitted via the line 158. The following input variables are supplied to the evaluation unit 160 for forming the activating signal. A signal representing the idle state of the engine is supplied by an idle detection circuit 162 via the connecting line 164; whereas, a signal representing the load of the engine is determined by the measuring unit 166 and transmitted via the connecting line 168, via the threshold value switch 170 as well as via the connecting line 172 to the evaluation unit 160. In addition, a determination unit 174 is provided for the start state of the engine and is connected to the evaluation unit 160 as well as to a further switch unit 168 via a line 176. The signal generated by the determination unit 174 is negatingly processed in the evaluation unit 160.

A second input of the integrator unit 156 defines the connecting line 180 which connects the integrator unit 156 to the switch unit 178. The switch unit 178 is further logically connected via a connecting line 182 to a storage element 184 wherein an initialization value of the integrator unit 156 is stored. The output line 186 of the integrator unit 156 is conducted via a limiter 188 and a unit 190 for correcting battery voltage, which, on the other hand, is connected via a line 192 to a measuring device 194 for detecting a battery voltage value. The output line 196 of the unit 190 connects the adaptation unit 14 to the storage and computation unit 16 of the inverse actuator characteristic curve.

The adaptation unit 14 is activated when switch unit 154 is closed. The conditions which must be present for activating the adaptation indicate the operating states of the engine during which the adaptation can be carried out. The function of the evaluation unit 160 corresponds therefore to a logic AND-function. The engine must be in a stable idle state for activating the adaptation. This is determined by the measuring device 162, for example, by detecting the closure of the idle switch of the throttle flap and of the subsequent pregiven time interval.

In addition, the start case of the engine is excluded via the negated evaluation of the start signal determined by the unit 174. During the start, the signal of the variable Q representing the air throughput is not useable for adaptation.

A further condition is pregiven by the threshold switch 170 wherein the load signal determined by the measuring unit 166 must lie below a load threshold pregiven by the threshold value switch 170. With this measure, the adaptation is limited to operating regions having overcritical pressure relationships in the intake system. The characteristic of the actuator is independent of the pressure difference between intake pressure and ambient pressure for overcritical conditions. Overcritical conditions are then present when the ratio of the intake pipe pressure and the ambient pressure is less than a pregiven value.

The evaluation unit 160 activates the adaptation via its output line 158 by closing the switch unit 154 when all three of the above-mentioned conditions are present at the same time. An application of the procedure described below is thereby also possible for pressure-controlled systems.

The starting operation is determined by the measuring unit 174. During the starting operation, the switch unit 178 is closed so that the integrator unit 156 is set to its initialization value stored in the storage element 184.

The difference formed from the input and actual values is supplied via the line 152 to the integrator unit 156 when the adaptation is activated. The integrator unit 156 integrates this difference so that the output signal thereof on line 186 is a measure for the deviation between input and actual values. The output signal is limited by the limiting unit 188 to physically realistic values.

A correction of the output signal of the integrator unit 156 is undertaken in the unit 190 as a function of the battery voltage via a battery-voltage dependent characteristic curve or a logic connection to a value dependent on battery voltage.

The adaptation value present on the output line of the adaptation unit 14 is then processed as described below for correcting the inverse actuator characteristic curve in the storage and computation unit 16.

As mentioned above, the characteristic curve 100 in FIG. 2*a* includes several regions with one region being present having a straight-line trace above a drive signal value $\sigma_0$.

The current, which fixes the position of the actuator in dependence upon the drive signal $\tau$ and therefore the magnitude of the operating variable to be controlled, is dependent on temperature via the winding resistance of the actuator drive. Furthermore, this current displays a dependency on battery voltage.

Temperature and battery voltage changes lead then to changes of the allocation of drive signal/operating variable. This means that the operating segment of the characteristic curve 100 is at least dependent on temperature and/or battery voltage with respect to its slope.

In contrast to the above, the axis segment A of the characteristic curve 100 is independent of the above outlined influences. The adaptation of the characteristic curve to the changes operating on the curve based on the influences described above is therefore undertaken by an adaptation of the slope S of the straight-line portion of the characteristic curve by means of rotating this portion of the characteristic curve about the fixed axis segment A specific to the engine (see characteristic curve 102 shown by the dot-dash line in FIG. 2*a* or characteristic curve 102' in FIG. 2*b*).

The integrator 156 or its output signal define a measure for the change of the characteristic curve since they were formed in the idle state in dependence upon the actual change which can be derived from the deviation between the input value V and the actual value Q.

The integrator output signal carries the data about the changes operating on the characteristic curve and, if necessary, is corrected in dependence upon battery voltage. This integrator output signal then corresponds to the necessary change of the slope of the characteristic curve for adapting the characteristic curve to the influences described above.

The characteristic curve slope of the inverse actuator characteristic curve is thereby corrected in dependence upon the integrator output signal and the characteristic curve is rotated about the fixed axis segment A specific to the engine.

Figure 4:
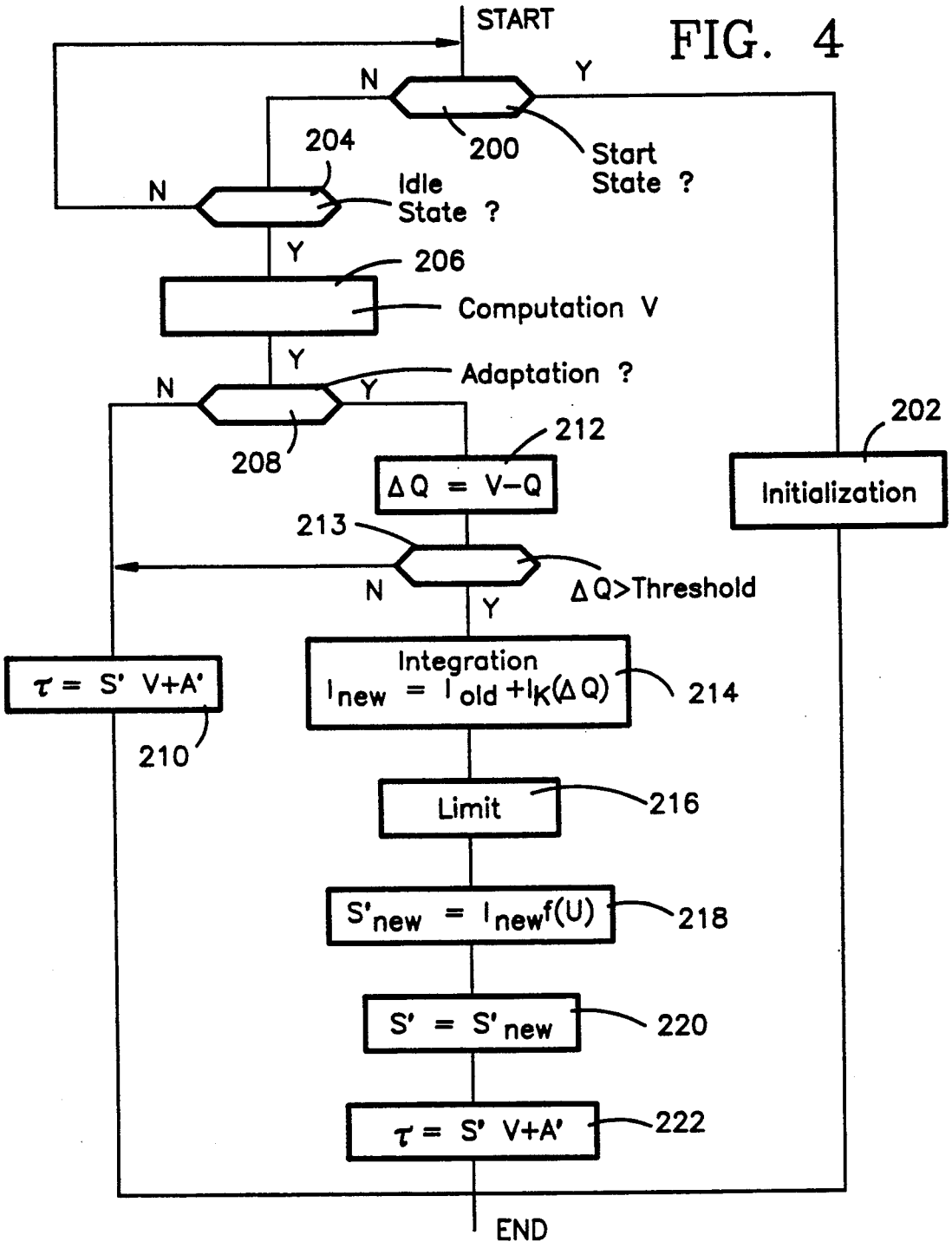

FIG. 4 makes clear the procedure according to the invention which is illustrated with respect to the block diagram of FIG. 3.

After the start of the program part, a check is made in step 200 as to whether a start condition of the engine is present. If this is the case, then the system is initialized in accordance with step 202. The initialization preferably comprises that the integrator is fixed to its start value. Thereafter, the program part is ended and started anew.

If in step 200, a decision was made that the start phase has run, that is, the engine is outside of its start condition, then a check is made in step 204 as to whether the engine is in a stable idle state. If this is not the case, then steps 200 and 204 are repeated until the stable idle state occurs.

In the stable idle case, the control unit 12 computes from its input signals the input value V for the operating variable to be controlled in accordance with step 206. In step 208, an inquiry is made as to whether the above-mentioned conditions for carrying out the characteristic curve adaptation are present. If this is not the case, then in step 210 and according to the above-mentioned equation of the inverse characteristic curve, the drive signal variable $\tau$ is computed or read out with a stored characteristic curve and the program part is ended and started anew.

If the adaptation conditions in step 208 are recognized as being fulfilled, then, in step 212, the difference of the input value V and the measured actual value Q of the operating variable to be controlled is computed.

Thereafter, an inquiry can take place with the aid of which a check is made as to whether the difference of these values is within a pregiven value range (step 213). If this is the case, then no adaptation is undertaken and continuation takes place with step 210. This measure is intended to prevent a response of the adaptation to small deviations and therefore prevent a continuous operation of the adaptation.

Step 213 can include still another inquiry which checks a time constancy of the difference value. In order to prevent an erroneous response of the adaptation for short-term change influences on the actuator characteristic curve, the condition can be imposed on the adaptation that the difference between the input value V and the actual value Q must be constant for a certain time. In the other case, continuation can be with step 210.

The difference is integrated in step 214 after step 213 which is not necessarily present but yet is advantageous. The integration result is then finally subjected in step 216 to a limitation which undertakes a maximum limitation or, for negative integrator values, a minimal limitation of the integration result.

The limited integration result is, according to step 218, corrected with a battery-voltage dependent value, for example, by multiplication so that after step 218 the integrator value defines a measure for the operating influences which effect changes as described above. The integrator value present after step 218 is then viewed as a new slope of the inverse characteristic curve according to step 220.

Thereafter, in step 222, the output signal variable $\tau$ corresponding to the above-outlined equation of the inverse characteristic is computed from fixed axis segment A', that is, pivot point, and the new determined slope S' which corresponds to the integration value determined by means of steps 214 to 218. For a characteristic stored in the form of a table, the characteristic values are adapted in step 222 to the new parameters and the drive signal variable $\tau$ is read out in dependence upon the controller output signal.

Thereafter, the program part is ended and started anew.

A further advantageous application of the concept according to the invention is for an adaptation of the engine-specific axis segment or pivot point to changing leakage air conditions.

Every actuator has a characteristic curve characterizing this actuator because of manufacturing tolerances of the individual components or because of adjustment measures. An adaptation of the characteristic curve, which serves to determine the drive rate and which is stored in the computer, is obtained at one point by the slope adaptation described above by rotating about a pivot point specific to the actuator outside of the characteristic curve or outside of the characteristic field. The slope adaptation therefore does not completely consider the conditions specific to the actuator. If the operating point of the actuator is, for example, outside of the reference point which is the basis of the slope adaptation, then a deviation of the actually adjusted operating point from the pregiven operating point can continue to exist. A complete adaptation of the stored characteristic curve to the conditions specific to the actuator is obtained by the long-term adaptation of the pivot point in combination with the slope adaptation with the pivot point lying outside of the characteristic curve or outside of the characteristic field.

Figure 5:
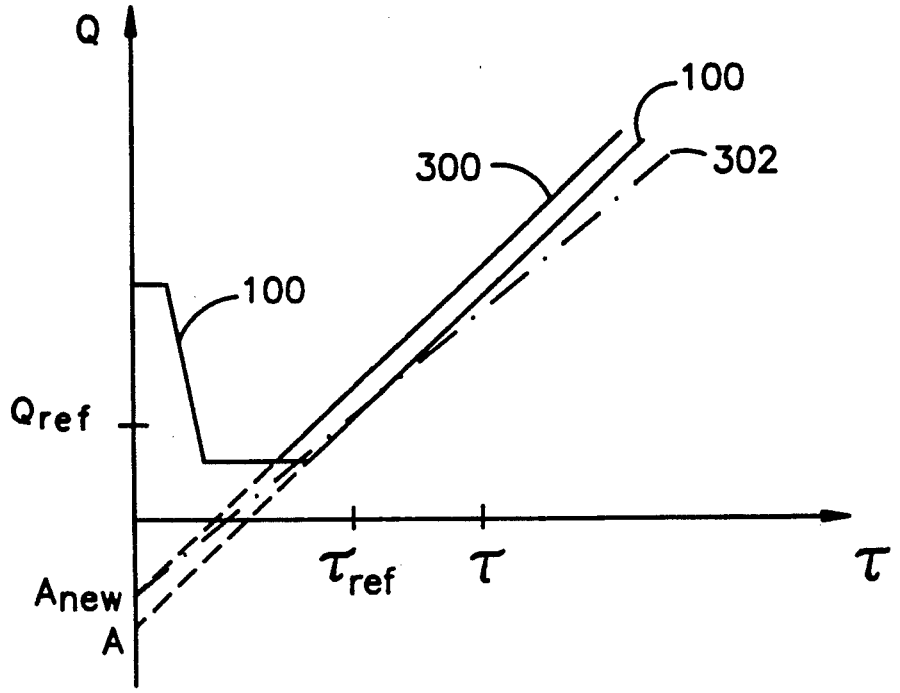

FIG. 5 shows the characteristic curve of an idle actuator known from FIG. 2*a* for influencing the air supply to an engine. The drive variable, the pulse-duty factor of the actuator or the current flowing through the actuator is plotted on the horizontal axis; whereas, the vertical axis describes the input air quantity or air mass. The characteristic 100 (solid line) is adapted in its operating segment for reference points $\tau_{ref}$ and $Q_{ref}$ by rotation about the pivot point A.

For a characteristic curve which is not adapted, a deviation of the air quantity or air mass actually adjusted by the actuator and the air quantity or air mass pregiven because of the stored characteristic curve is determined in the desired operating point $\tau$ even though the characteristic curve was adapted for the reference point. The following procedure is followed for further adapting the characteristic curve by adapting the pivot point. The pivot point is changed (new pivot point $A_{new}$) when a deviation is determined. This means a parallel shift of the operating segment of the characteristic curve in the sense of an increase of the deviation (characteristic curve 300). Thereafter, the characteristic curve is adapted (characteristic curve 302) to the conditions specific to the actuator at operating point $\tau$ by the above-illustrated adaptation of the slope. In this way, a characteristic is finally stored which considers the conditions specific to the actuator. Changes at the actuator do not occur very often during the operating duration of the actuator. For this reason, the pivot point adaptation is a long-term adaptation in comparison to the slope adaptation.

The pivot point adaptation shown in FIG. 5 is in the sense of an increase of the air quantity or air mass. In addition to this pivot point adaptation, a lowering, that is, a shift of the pivot point can be provided downwardly for other conditions.

The measures described above have corresponding effects on the inverse characteristic curve shown in FIG. 2*b*. In addition, the embodiments described below apply in the same manner for the inverse characteristic curve.

Figure 6:
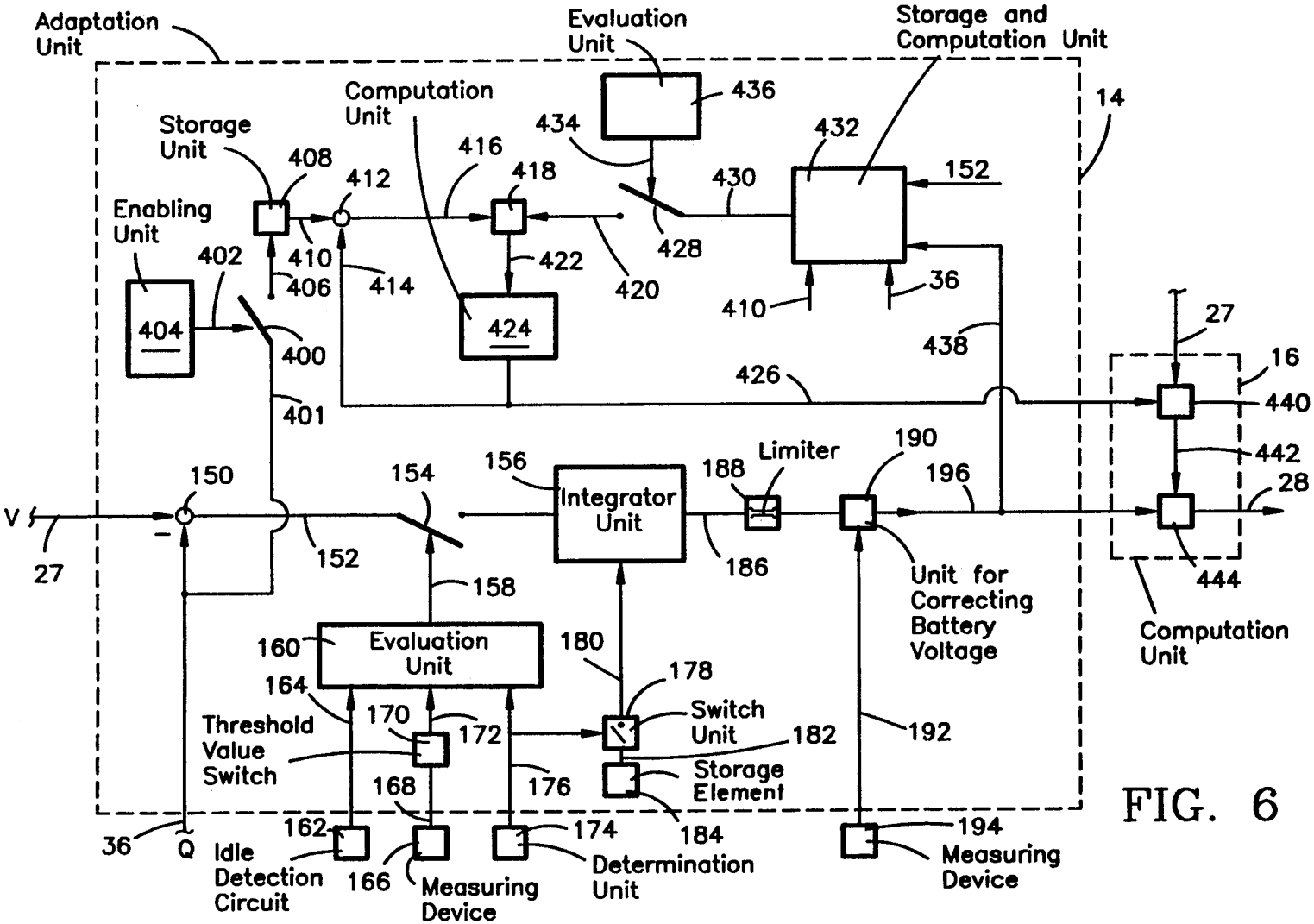
FIG. 6 shows an embodiment for the pivot point adaptation and slope adaptation in the form of an overview block circuit diagram.

FIG. 6 shows a first embodiment for carrying out the pivot point adaptation in combination with a slope adaptation. FIG. 6 is in the form of an overview block circuit diagram.

The reference numerals are the same for the elements known from FIG. 3. Reference is made to the description of FIG. 3 with reference to their operation.

In this embodiment, the adaptation unit 14 additionally includes a further switch element 400 which is connected via line 401 to the line 36. The switch element 400 is actuable via connecting line 402 by enabling means 404. A further line 406 connects the switch element 400 to an input of a storage element 408. An output of the storage element 408 defines the line 410 which connects the storage element 408 to a logic connection point 412. The logic-operation point 412 includes the line 414 as a second input line whereas the output line 416 of the logic-operation point 412 connects logic-operation point 412 to a further logic-operation point 418. The logic-operation point 418 has the line 420 as a second input line. The output line 422 of logic-operation point 418 connects the latter to a computation element 424. The line 414 is an output line of the computation element 424; whereas the line 426 is the output line of the computation element 424 and the adaptation unit 14 itself. The line 420 connects a switch element 428 to the logic-operation point 418. The other end of the switch element 428 is connected via a line 430 to a storage and computation unit 432. The switch element 428 is connected via a line 434 to the enabling means 436 and is actuable via this enabling means. The line 152, the lines 36 and 410 as well as a line 438 lead to the storage and computation element 432 with line 438 being branched from the output line 196 of the adaptation unit 14.

The two output lines 426 and 196 of the adaptation unit 14 as well as the line 27 lead to the computation unit 16. Lines 27 and 426 are connected at a first logic-operation point 440. The output line 442 of the logic-operation point 440 is connected via a logic-operation element 444 to the line 196. The output line 28 of the computation unit 16 is the output line of the logic-operation element 444.

For reasons of clarity, the lines which supply the corresponding information to the enabling means 404 and 436 are omitted. In dependence upon this information, the closure and opening of the switch elements 400 and 428 are undertaken. A person of skill can however easily determine the corresponding interrelationships from the description which follows.

If the difference between the desired and actual values of the air quantity or air mass drops below a predetermined value during active slope adaptation, that is, with switch element 154 closed, the switch element 400 is closed by enabling means 404 and the current actual value of the air quantity or air mass is transferred into the storage unit 408 as reference value $Q_{ref}$. In this way, the characteristic curve for the stored reference value is adapted by adaptation of its slope.

The adaptation of the pivot point A is based on the following concept. The reference value for the air quantity or air mass, which was stored before the pivot point adaptation with slope adaptation, must remain a component of the characteristic curve after completion of the pivot point adaptation with slope adaptation. Furthermore, an adaptation of the characteristic curve is to be obtained for the new operating point so that the actual supplied air quantity or air mass corresponds to the air quantity or air mass pregiven for the reference point and operating point via the adapted characteristic curve.

The storage and computation unit 432 determines the slope of a new characteristic curve on the basis of the reference point and of the measured actual value of the air quantity or air mass. This new characteristic curve includes the reference point as well as the new operating point. The computation of the slope takes place with the known characteristic curve equation on the basis of the desired-value/actual-value difference of the air quantity or air mass supplied on the line 154, the deviation of the measured value of the air quantity or air mass supplied via the line 36 from the reference value supplied via line 410 and the existing slope of the characteristic curve (slope triangle) supplied via the line 438. From the computed new slope and the known old slope, the storage and computation unit determines the relative slope change ((slope new-slope old)/slope new).

The new pivot point is computed via evaluating the relative slope change on the basis of a characteristic curve equation having changed slope and pivot point which equation satisfies the above-mentioned requirements and includes the reference point and measuring point. The pivot point change results from the sum of the reference point value and the value of the previous pivot point multiplied by the relative slope change.

The enabling means 334 closes the switch element 428 when the pregiven conditions are present for carrying out the pivot point adaptation. A pivot point adaptation is carried out in a time window after closing the idle switch with the lower time threshold being so selected that, in pressure-control systems, a falsification of the air quantity or air-mass measured value by an intake pipe which is still full is prevented and the maximum value of the time window is so selected that the previously learned reference point retains its validity. In addition, a successful slope adaptation must be completed before closure of switch element 428, for example, a certain time in advance of activating the pivot point adaptation, so that the learned reference value can be the basis for the further computation. In addition, the current air quantity or air-mass quantity value must be significantly greater than the stored reference value in order to ensure an adequate measuring accuracy by means of an adequately large difference. Alternately, a pivot point adaptation can be undertaken at selected operating points when overrun conditions (closed idle switch, increased engine speed) and the above-mentioned conditions are present.

The computation unit 424 integrates the product formed in the logic-operation element 418 from the relative slope change during the slope adaptation and the sum of the reference air quantity or reference air-mass value and the currently present pivot point, that is, the necessary pivot point change computed as described above. The computation unit 424 performs this integration when the switch element 428 is closed and emits a measure for the pivot point on the lines 426 and 414.

In the following, the new slope is adjusted by means of the described slope adaptation.

In the computation unit 16, the above-mentioned actuator characteristic curve equation is formed by means of addition of the desired value supplied by the controller via the line 27 and the pivot point emitted via line 426 as well as by means of subsequent multiplication of the sum with the slope of the characteristic curve supplied on line 196. The computation unit 16 then supplies a drive signal via line 28 for adjusting the desired value.

Figure 7:
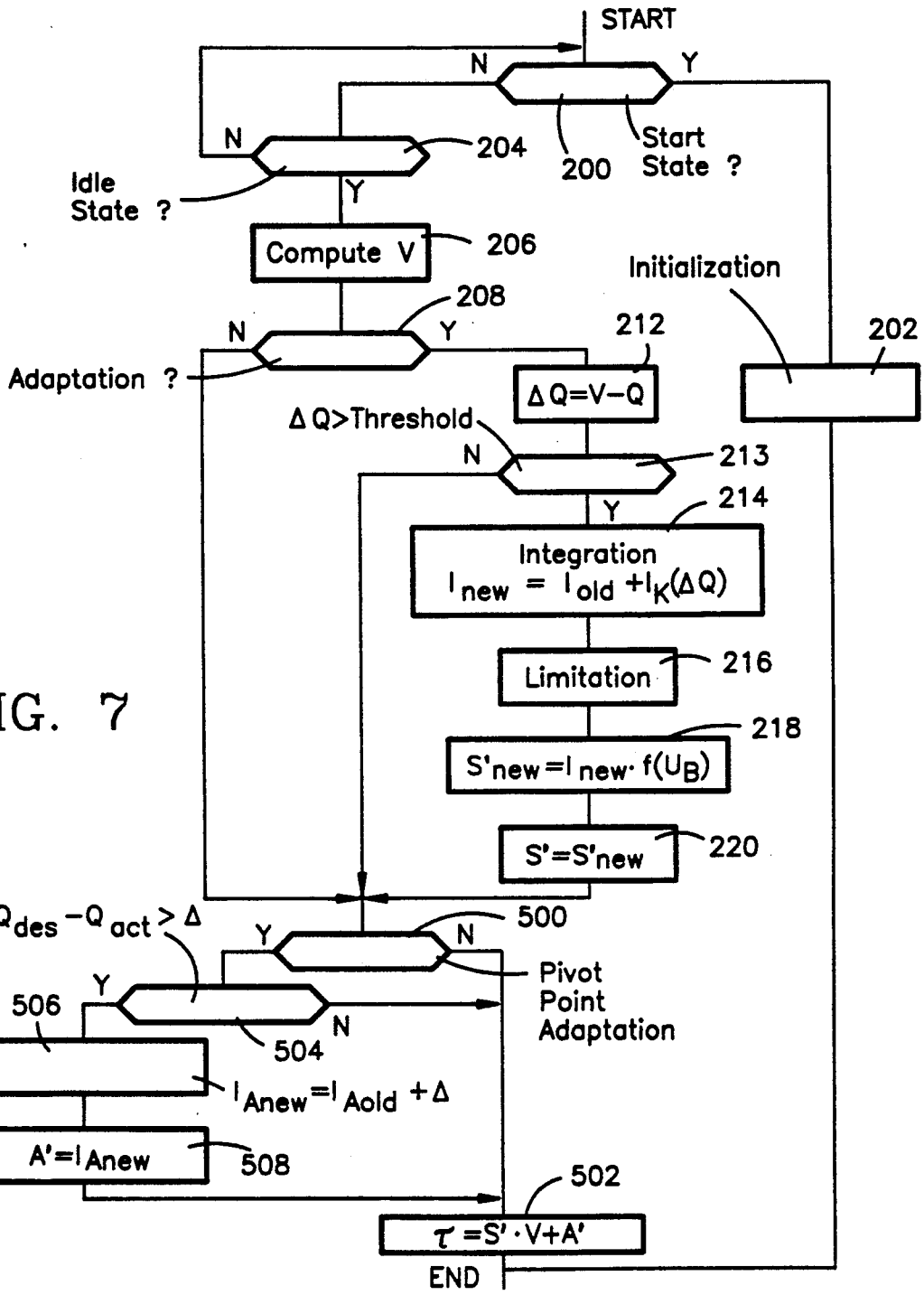
In FIG. 7, a flowchart shows a sketch of a realization of the pivot point and slope adaptation in the form of a computer program.

With a flowchart, FIG. 7 shows a further embodiment of the concept of the invention in the form of a sketch of a computer program. This embodiment is advantageous because of its simplicity.

FIG. 7 shows elements which are known already from FIG. 4. These elements have the same reference numerals and fulfill the same functions. With reference to their operation, reference is therefore made to the description of FIG. 4.

After the start of the program part and working through the step 200 to 220, an inquiry is made in a step 500 as to whether the above-mentioned conditions for carrying out the pivot point adaptation are present. For a no-decision in step 213, the reference value is stored after a successful completion of the slope adaptation. The conditions for carrying out the pivot point adaptation are checked, for example, with counters running at the same time and set marks. If the conditions for carrying out the pivot point adaptation are not present, then the step 502 is carried out after the inquiry step 500 for which the drive signal variable is computed on the basis of computed slope and pivot point values via the inverse characteristic curve. If, according to step 500, the conditions for carrying out the pivot point adaptation are present, then in inquiry step 504, a check is made as to whether a difference between the desired and actual values of the air quantity or air mass is present which is greater than a pregiven value $\Delta$ at the operating point which is present. If this is not the case, then step 502 follows. If the opposite condition is present and for an existing deviation, an integrator, in which a measure for the change of the pivot point is stored, is changed by a pregiven value in step 506. The change of the integrator position takes place then in dependence upon the sign of the deviation and can be selected to be dependent upon the magnitude of this deviation in an advantageous embodiment. Here, it is to be noted that the pivot point is always changed in that a characteristic curve shift in the sense of an increase of the deviation is the consequence. That is, the integrator position is increased when the deviation between the desired and actual values is positive. In this way, a larger deviation occurs first which, however, can subsequently be reduced by slope adaptation. In step 508, the pivot point value utilized for computing the drive signal variable is set to the state of the integrator. Thereafter, in step 502, the drive signal variable is computed and emitted.

Since the pivot point is a measure for the leakage air quantity flowing to the engine, values as to the leakage air quantity can be derived for diagnostic purposes from the pivot point learned and stored.

In addition to the two described embodiments, other advantageous adaptation methods are conceivable which combine the two embodiments.

We claim:

1. A method for controlling an operating variable of an internal combustion engine of a motor vehicle, via at least one transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable ($\tau$) and a variable representing this operating variable in the form of a characteristic curve or a characteristic field and said method carrying out an adaptation of the control to changing operating conditions in that the characteristic curve or characteristic field is adapted by adaptation to the changing conditions, the method comprising the step of:

performing the adaptation so as to cause at least one region, which is to be adapted, of the characteristic or characteristic field to rotate about a pregiven point (A, A') of rotation determined by said transfer element; and, said point (A, A') of rotation representing an output variable (Q) which would result for said region for a characteristic value of said drive variable ($\tau$).

2. The method of claim 1, wherein the transfer element is an actuator element which influences the air supply to the engine and is used for an idle engine speed control.

3. The method of claim 1, further comprising the step of characterizing said characteristic curve by at least one parameter; and, causing said characteristic curve to have a trace having a straight-line form in at least one region.

4. The method of claim 3, further comprising the step of undertaking the adaptation of the characteristic by changing said at least one parameter characterizing the characteristic curve in dependence upon the measured variable influenced by the actuator element and a value, which represents this variable and is pregiven by the control.

5. The method of claim 1, comprising the step of causing said parameter to be the slope of the characteristic curve in at least one region thereof; and, adjusting said characteristic curve in dependence upon the difference between the measured and pregiven value.

6. The method of claim 1, comprising the further step of correcting said at least one parameter characterizing the characteristic curve in dependence upon the battery voltage.

7. A method for controlling an operating variable of an internal combustion engine of a motor vehicle, via at least one transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable and a variable representing this operating variable in the form of a characteristic curve or a characteristic field and said method carrying out an adaptation of the control to changing operating conditions in that the characteristic curve or characteristic field is adapted by adaptation to the changing conditions, the method comprising the steps of:

performing the adaptation in such a manner that at least one region of the characteristic curve or characteristic field is rotated above a pregiven point specific to the engine and disposed outside of the characteristic curve or characteristic field; and, determining said point by a fictive value of the operating variable for the drive variable zero on the basis of at least one region of the characteristic curve or of the characteristic field.

8. A method for controlling an operating variable of an internal combustion engine of a motor vehicle, via at least one transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable and a variable representing this operating variable in the form of a characteristic curve or a characteristic field and said method carrying out an adaptation of the control to changing operating conditions in that the characteristic curve or characteristic field is adapted by adaptation to the changing conditions, the method comprising the step of:

performing the adaptation in such a manner that at least one region of the characteristic curve or characteristic field is rotated about a pregiven point specific to the engine and disposed outside of the characteristic curve or characteristic field only outside of the start case of the engine in the idle operating phase thereof when the load of the engine drops below a pregiven threshold value.

9. An arrangement for controlling an operating variable of an internal combustion engine of a motor vehicle, with a transfer element, said transfer element fixing the relationship between input and output variables in the form of a characteristic curve or a characteristic field, said transfer element being an electrically actuable actuator, which represents said operating variable and which is driven by the control, said actuator fixing the relationship between drive variable and a variable representing this operating variable in the form of a characteristic curve or a characteristic field and an adaptation unit which performs an adaptation of the control to changing operating conditions in that the characteristic curve or characteristic field is adapted by adaptation to the changing conditions, the arrangement comprising means for performing the adaptation so as to cause at least one region, which is to be adapted, of the characteristic or characteristic field to rotate about a pregiven point (A, A') of rotation determined by said transfer element; and, said point (A, A') of rotation representing an output variable (Q) which would result for said region for a characteristic value of said drive variable ($\tau$).

10. An arrangement for controlling an operating variable of an internal combustion engine of a motor vehicle, with a transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable and a variable representing this operating variable in the form of a characteristic curve or a characteristic field and an adaptation unit which performs an adaptation of the control to changing operating conditions in that the characteristic curve or characteristic field is adapted by adaptation to the changing conditions, the arrangement comprising:

means for performing the adaptation in such a manner that at least one region of the characteristic curve or characteristic field is rotated about a pregiven point specific to the engine and disposed outside of the characteristic curve or characteristic field; and, means for determining a point (A) by a fictive value of the operating variable for the drive variable zero on the basis of at least one region of the characteristic curve or of the characteristic field.

11. The arrangement of claim 9, wherein the adaptation unit includes means which changes a parameter characterizing the characteristic curve in dependence upon the deviation of the measured operating variable of the engine, which is influences by the actuator and upon the value of the operating variable pregiven by the control, said parameter being especially the slope.

12. The arrangement of claim 9, further comprising means which activate that adaptation unit in pregiven operating states.

13. The arrangement of claim 10, wherein the adaptation unit includes means which correct the slope in dependence upon battery voltage.

14. The arrangement of claim 10, wherein the adaptation unit includes integrating elements which process the deviation between measured and pregiven values and which influence at least one parameter in dependence upon this deviation.

15. A method for controlling an operating variable of an internal combustion engine of a motor vehicle, via at least one transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable and operating variable or a variable representing this operating variable in the form of a characteristic curve or a characteristic field and said method carrying out an adaptation of the control to changing operating conditions in that the characteristic curve or characteristic field is adapted by adaptation to the changing conditions, the method comprising the step of performing the adaptation so that at least one region of the characteristic curve or characteristic field is rotated about a pregiven point specific to the engine or the actuator and disposed outside of the characteristic curve or characteristic field and this pivot point being adaptable within the context of a long-term adaptation.

16. The method of claim 15, comprising the further steps of:

starting from a reference point adapted by slope adaptation and at another operating point; and, changing pivot point and slope such that reference point as well as operating point lie on another characteristic curve.

17. The method of claim 15, comprising the further step of carrying out of the pivot point adaptation only in a pregiven time span after entry of the idle state when the slope adaptation was successful before a certain time and the current air quantity or air mass is greater than the air quantity or air mass at the reference point.

18. The method of claim 15, comprising the further step of changing a value representing the pivot point in the sense of an increase of the deviation when the conditions are present for carrying out the pivot point adaptation and a deviation of the actual load signal value from the pregiven value in the operating point.

19. An arrangement for controlling an operating variable of an internal combustion engine of a motor vehicle, with a transfer element, said transfer element fixing the relationship between input and output variables in the form of a characteristic curve or a characteristic field, said transfer element being an electrically actuable actuator, which influences said operating variable and which is driven by the control, said actuator fixing the relationship between drive variable and operating variable or a variable representing this operating variable in the form of a characteristic curve or a characteristic field and an adaptation unit which performs an adaptation of the control to changing operating conditions in that the characteristic curve or characteristic field is adapted by adaptation to the changing conditions, the arrangement comprising means for performing the adaptation in such a manner that at least one region of the characteristic curve or characteristic field is rotated about a pregiven point specific to the engine or to the actuator and disposed outside of the characteristic curve or characteristic field, and this pivot point being adaptable within the context of a long-term adaptation.

* * * * *

UNITED STATES PATENT AND TRADEMARK OFFICE

CERTIFICATE OF CORRECTION

PATENT NO. : 5,293,852

DATED : March 15, 1994

INVENTOR(S) : Vera Lehner, Ernst Wild, Helmut Janetzke and Klemens Grieser

It is certified that error appears in the above-identified patent and that said Letters Patent is hereby corrected as shown below:

On the Title Page, Item [54], line 2, delete "CLOSE-LOOP" and substitute -- CLOSED-LOOP -- therefor.

In column 1, line 2: delete "CLOSE-LOOP" and substitute -- CLOSED-LOOP -- therefor.

In column 7, line 43: delete "$\sigma_0$" and substitute -- $\tau_0$ -- therefor.

In column 10, line 42: between "whereas" and "the" (second occurrence), insert -- , --.

In column 15, line 21: delete "influences" and substitute -- influenced -- therefor.

Signed and Sealed this

Second Day of August, 1994

*Attest:*

*Attesting Officer*

BRUCE LEHMAN

*Commissioner of Patents and Trademarks*